United States Patent [19]

Messina

[11] Patent Number: 4,651,626

[45] Date of Patent: Mar. 24, 1987

[54] SEMI-ROTATING SINGLE ACTING PNEUMATIC ACTUATOR

[76] Inventor: Aurelio Messina, Via Cialdini, 74, 20161 Milano, Italy

[21] Appl. No.: 743,766

[22] Filed: Jun. 12, 1985

[30] Foreign Application Priority Data

Jul. 6, 1984 [IT] Italy ..... 21804 A/84

[51] Int. Cl.[4] ..... F15B 15/24

[52] U.S. Cl. ..... 92/13.6; 92/130 D; 92/133; 92/136; 92/138

[58] Field of Search ..... 92/136, 138, 13.6, 128, 92/130 D, 133; 267/170, 179; 74/109, 422

[56] References Cited

U.S. PATENT DOCUMENTS

| | | | |
|---|---|---|---|
| 2,272,091 | 2/1942 | Loewe | 92/133 |
| 3,175,473 | 3/1965 | Boteler et al. | 92/128 |
| 3,618,473 | 11/1971 | Miller | 92/133 |
| 4,354,424 | 10/1982 | Nordlund | 92/130 D |
| 4,392,631 | 7/1983 | Dewald | 92/136 |

FOREIGN PATENT DOCUMENTS

| | | | |
|---|---|---|---|
| 2128682 | 5/1984 | United Kingdom | 92/136 |

*Primary Examiner*—Margaret A. Focarino
*Assistant Examiner*—Noah Kamen
*Attorney, Agent, or Firm*—Bucknam and Archer

[57] ABSTRACT

The actuator has a plurality of springs in a circular array, for effecting return movement of two pistons slidable in a bore in the actuator body and each having a rack portion meshing with a pinion on an output shaft extending perpendicularly of the axis of the bore, the springs being each arranged in individual seatings defined by blind holes in the pistons and a circular array of through holes in apertured disc members, and being maintained in position by means of a respective flanged apertured spring guide carrying an end cap adjustably held on to the spring guide by a hollow screw with an internal threaded through hole therein a threaded rod is engaged effective to act as a piston stroke limit member.

1 Claim, 2 Drawing Figures

SEMI-ROTATING SINGLE ACTING PNEUMATIC ACTUATOR

BACKGROUND OF THE INVENTION

The present invention relates to a single acting semi-rotating fluid pressure actuator provided with return springs secured by a single end cap.

As is known, the rotary movement of the shutter of particular types of valves, for the opening and closure of such valves, can be advantageously derived from the movement of rotary actuators, generally actuators functioning by means of a fluid under pressure such as hydraulic or pneumatic actuators. Such actuators are essentially constituted by an hydraulic or pneumatic directly or indirectly driven semi-rotating motor. The term "semi-rotating" will be understood to refer to a member having a limited range of rotary movement, usually less than a complete revolution.

In particular, indirectly driven actuators of this type comprise two opposed pistons in a cylinder on which pistons the fluid under pressure acts and from which pistons the movement and the forces are transmitted to an output shaft by means of a rack and pinion coupling. The return stroke of the pistons themselves is usually obtained by means of the action of biasing springs.

This arrangement, whilst being advantageous for many purposes and whilst having great operating reliability, does however present certain practical difficulties of assembly and maintenance. In fact, assembly is difficult because after having assembled the pistons, the insertion and retaining of the springs in their associated seatings involves a laborious operation including compression of the springs to fit the sealing end caps given the diameters of the springs themselves and their consequent resistance to compression.

The complexity of such operations in practice renders in situ maintenance of the actuator impossible, therefore making it necessary first to remove it from its working position for any necessary maintenance operations such as exchange of the springs, changing the seals or internal cleaning in general etc. It is in fact dangerous, and practically impossible, to dismantle the end caps from actuators of conventional type having return springs unless suitable specialised tools are available such as, for example, locking vices and presses able to resist and contain the thrust action of a multiplicity of springs.

Moreover, in currently available spring return single acting actuators it is not possible to effect a correct adjustment of the load of the springs in relation to the control pressure and the resisting couple of a valve worked by the actuator, without replacing the springs themselves.

SUMMARY OF THE INVENTION

The present invention seeks therefore to provide a semi-rotating spring returned fluid pressure actuator which will be safe, easy and rapid to assemble and dismantle.

Another object of the invention is that of providing a semi-rotating spring returned fluid pressure actuator which does not require preliminary removal from the installation in order to dismantle it for maintenance or adjustment purposes.

Another object of the present invention is that of providing a semi-rotating spring returned fluid pressure actuator in which it is possible with simple operations to effect a substantially continuous adjustment of the load on the springs.

According to the present invention, there is provided a semi-rotating pneumatic actuator having a piston in a cylindrical bore in a tubular body, in which the return thrust on the piston is exerted by a plurality of cooperating springs having parallel axes and each arranged in an individual seating, characterised by the fact that the springs are held in their seats by means of a spring guide, rigidly connected to the actuator body and having an end cap coupled to the said spring guide by means of a screw with a threaded internal through hole in which a threaded rod is threadedly engaged, this latter being adjustable whereby to regulate the stroke of the corresponding piston; the length of the said hollow screw being such that removal thereof from the said spring guide to allow removal of the end cap allows extension of the springs to a completely relaxed state.

Preferably the said body is a tubular body having a bore of circular section housing an apertured disc adjacent each end, each disc having a circular array of apertures concentric with the centre of the disc, characterised in that each of two pistons in the bore are provided with blind holes in corresponding positions, the pistons having opposite portions formed as respective racks which mesh with a pinion mounted on an output shaft of the actuator.

BRIEF DESCRIPTION OF THE DRAWINGS

One embodiment of the invention will now be more particularly described, by way of example, with reference to the accompanying drawings, in which.

DESCRIPTION OF THE PREFERRED EMBODIMENT

Figure 1:
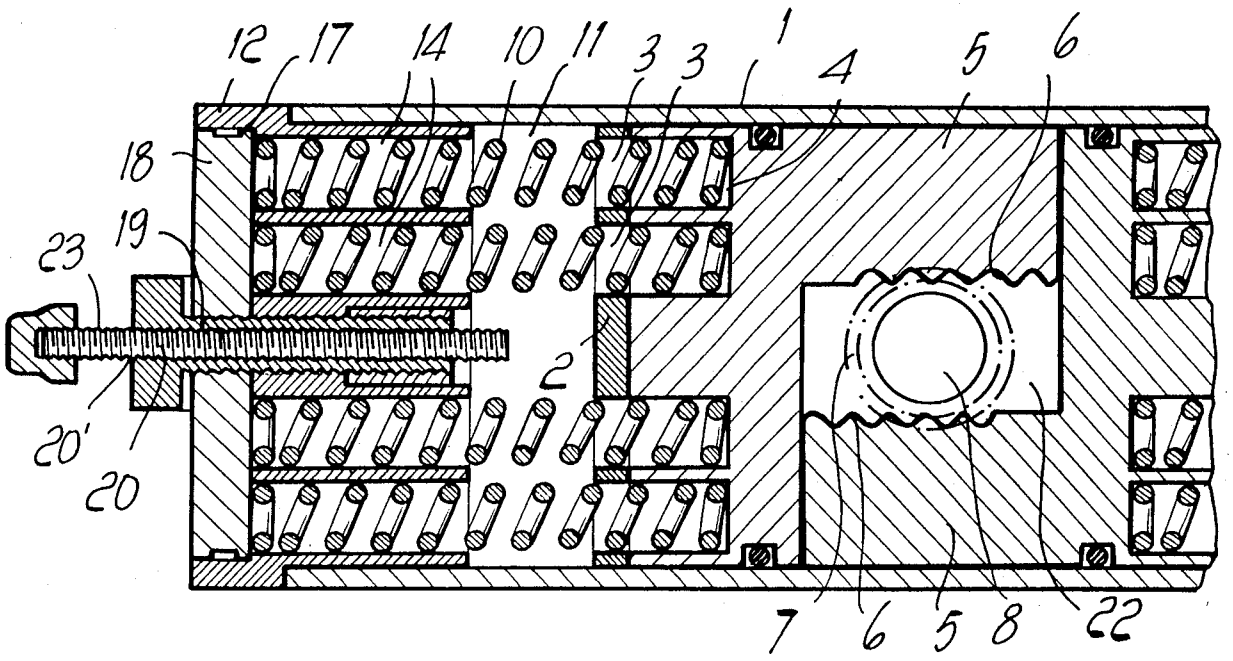
FIG. 1 is a longitudinal section schematically illustrating an actuator formed as an embodiment of the invention.
Figure 2:
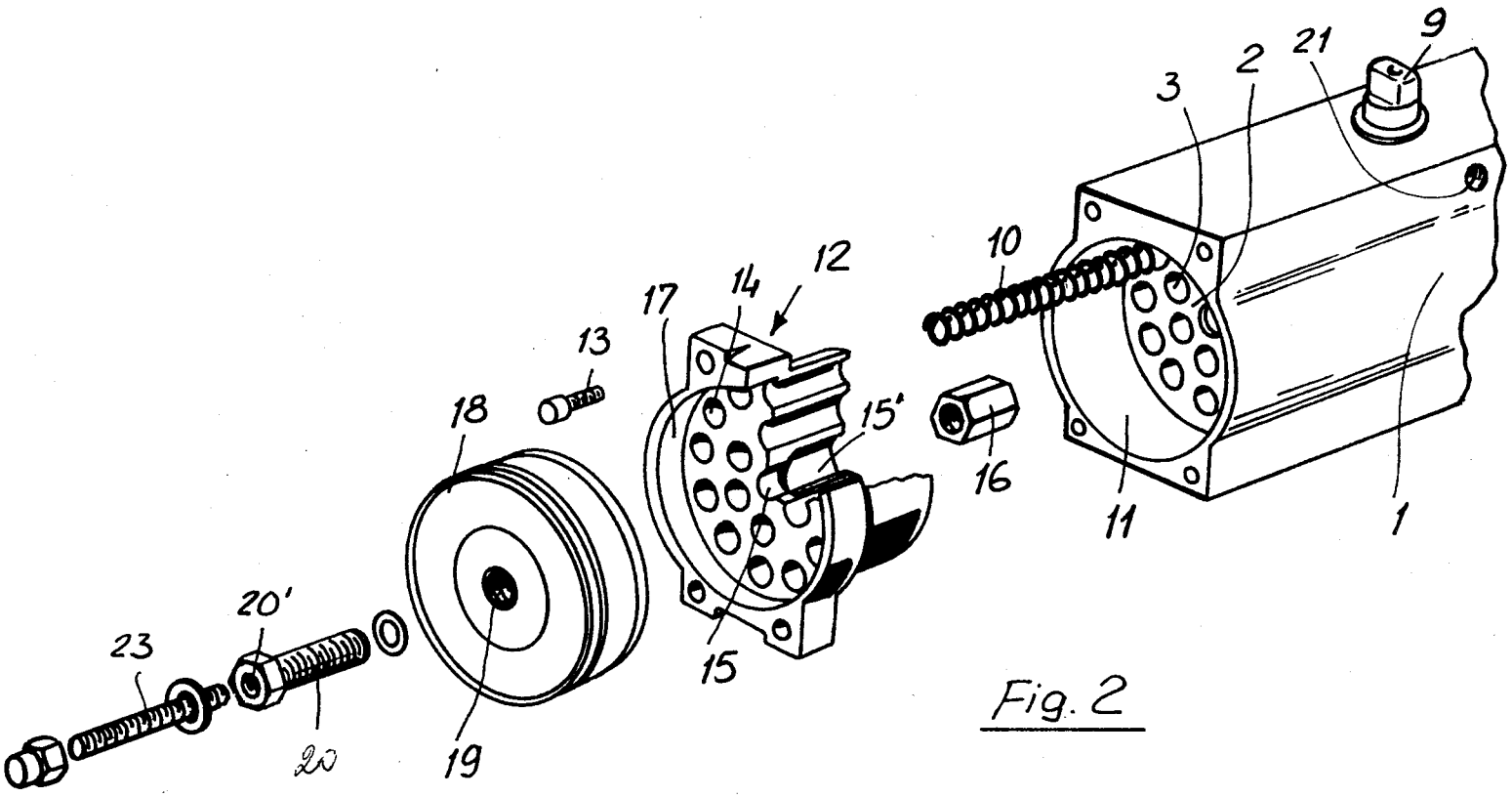
FIG. 2 is an exploded perspective view of one end portion of the actuator illustrated in FIG. 1.

With reference now to the various figures of the attached drawings, there is shown a semi-rotating spring returned pneumatic actuator comprising a tubular body 1 having a bore with a circular cross-section and provided close to its two end portions with two discs 2 each having a circular array of axial through holes 3 symmetrically spaced around the disc and concentric with the axis of the disc 2 and the bore in the body 1 in which it is located.

Between the discs 2 are located two oppositely directed pistons 5 having blind axial holes 4 formed in corresponding positions in the faces directed away from the other of the two pistons 5. The opposite faces of the pistons 5, that is the faces directed towards one another, are provided with connterposed extensions each in the form of a rack 6 which meshes with a toothed pinion 7 mounted on an output shaft 8 which projects from the body 1 and is provided with a suitably shaped end 9 for connection to a member to be turned by the actuator. In the said through holes 3 and the blind holes 4 there are lodged a corresponding number of helical piston-biasing springs 10 of suitable mechanical characteristics.

Oppositely facing cylindrical seatings 11 are defined by the end portions of the body 1 and the apertured discs 2, and in these, seatings are fitted respective flanged disc-shaped spring guides 12 which are each fixed to the body itself by means of set screws 13. Each spring guide 12 has a plurality of through holes 14 formed in positions corresponding with those of the said through holes 3 and blind holes 4 in the apertured discs 2 and the pistons 5 respectively.

Also, each spring guide 12 has a central aperture 15 having a polygonal prismatic portion 15 in which a correspondingly shaped prismatic internally threaded bush 16 can be engaged.

The flange of each said spring guide 12, in particular, defines a further cylindrical seat 17 in which is lodged a disc-shaped end cap 18 provided with a threaded central aperture 19 through which extends a hollow tubular screw 20 of adequate length the internal bore 20' of which is correspondingly threaded. The hollow screw 20 threadedly engages in the polygonal prismatic bush 16 fitted in the central aperture of the spring guide 12. The end cap 18, by abutting with its inner flat face against the springs 10, retains the springs 10 in their seatings, but is removable to allow inspection, replacement or variation in the number of springs themselves in a simple and rapid manner. The threaded bore 20' in the said hollow screw 20 receives a central threaded rod 23 the end of which can engage the associated piston to limit the stroke thereof to the desired value.

As it is shown the hollow 20 has a prismatic head effective to be engaged by a suiltable wrench in order to adjust the pushing force of the end cap 18 against the springs 10: in other words the screw 20 permits a gradual and progressive release or increase of the springs as the screw is slackened or tightened to remove the end cap or further advance it toward the spring guide 12. The length of the said hollow screw is such that by the time it has been slackened to allow disengagement from the threaded bush 16 the springs are already completely relaxed. By means of this arrangement maintenance and replacement of the springs is enormously facilitated, as well as the possibility of varying the number thereof and, consequently, the couple applied by the actuator under spring pressure.

The control fluid for the actuator is supplied through a suitable hole 21 in the side of the body, from which extends a duct (not shown) which conveys it into the chamber 22 delimited by the two pistons 5 and the walls of the tubular body 1.

I claim:

1. A semi-rotating pneumatic actuator comprising a tubular body defining a cylindrical bore housing two valve shutter actuating pistons, each piston being provided with a plurality of blind holes and with opposite portions formed as respective racks meshing with a pinion mounted on an output shaft of said actuator, said two pistons defining a chamber for receiving an operating fluid, two disc members housed in said body, each disc abutting on a respective said piston and having a circular array of apertures registered with said blind holes in said pistons, two flanged disc-shaped spring guides arranged in said body adjacent the ends thereof and rigidly removably coupled thereto, each spring guide having a circular array of apertures registered with said apertures of a said disc member, each said spring guide being further provided with a central through hole having a polygonal portion in which an internally threaded bush is engageable, each said flanged spring guide defining an outer cylindrical seat in which there is received a respective disc shaped end cap having a central through hole through which extends a hollow screw engaged in said bush, said hollow screw having a threaded axial through hole in which is threadedly engaged an adjustment screw on end of which is engageable with the adjacent piston whereby to determine the end of the stroke of the piston, and a plurality of piston biassing springs threaded through the registered holes of said pistons and apertrures of said disc members and spring guides, the outer ends of said springs adjustably abutting against the flat inner face of a respective said end cap.

* * * * *